United States Patent [19]

Corben

[11] 4,332,888

[45] Jun. 1, 1982

[54] METHOD FOR STABILIZING AND SPECTRALLY SENSITIZING PHOTOSENSITIVE SILVER HALIDE EMULSION

[75] Inventor: Leo D. Corben, Swampscott, Mass.

[73] Assignee: Polaroid Corporation, Cambridge, Mass.

[21] Appl. No.: 121,800

[22] Filed: Feb. 15, 1980

Related U.S. Application Data

[63] Continuation of Ser. No. 962,339, Nov. 20, 1978, abandoned.

[51] Int. Cl.[3] ..... G03C 1/34; G03C 1/08

[52] U.S. Cl. ..... 430/570; 430/219; 430/240; 430/569; 430/606; 430/607; 430/611; 430/615

[58] Field of Search ..... 430/219, 240, 569, 570, 430/606, 607, 611, 615

[56] References Cited

U.S. PATENT DOCUMENTS

| | | | |
|---|---|---|---|
| 2,444,607 | 7/1948 | Heimbach | 430/615 |
| 2,444,609 | 7/1948 | Heimbach et al. | 430/615 |
| 2,449,225 | 9/1948 | Heimbach | 430/615 |
| 2,450,397 | 9/1948 | Heimbach | 430/615 |
| 2,743,180 | 4/1956 | Carroll . | |
| 2,772,164 | 11/1956 | Allen et al. | 430/611 |
| 2,835,581 | 5/1958 | Tinker et al. | 430/615 |
| 3,161,506 | 12/1964 | Becker | 430/219 |
| 3,333,961 | 8/1967 | Fry et al. | 430/611 |
| 3,418,130 | 12/1968 | Stevens et al. | 430/611 |
| 3,462,272 | 8/1969 | Duffin et al. | 430/611 |
| 3,556,788 | 1/1971 | Ryan | 430/219 |
| 3,563,755 | 2/1971 | Anderson et al. | 430/615 |
| 3,904,620 | 9/1975 | Anderson | 430/615 |
| 3,929,486 | 12/1975 | Habu et al. | 430/607 |
| 4,011,083 | 3/1977 | Durning et al. | 430/570 |
| 4,026,707 | 5/1977 | Obikawa et al. | 430/607 |
| 4,078,937 | 3/1978 | Tani et al. | 430/568 |
| 4,126,472 | 11/1978 | Sakai et al. | 430/264 |

OTHER PUBLICATIONS

Birr, E. J., "Stabilization of Photographic Silver Halide Emulsions", The Focal Press 1975, pp. 29, 65, 66, 79–81, 83–95, 202–203, 232–233 & 249.

*Primary Examiner*—Charles L. Bowers, Jr.
*Attorney, Agent, or Firm*—Philip G. Kiely

[57] ABSTRACT

Photosensitive silver halide emulsions are provided with enhanced stability by the following sequence of steps:

(a) providing sufficient stabilizer to the emulsion to stop chemical ripening but insufficient to interfere with spectral sensitization;

(b) spectrally sensitizing said emulsion; and (c) adding to said emulsion a water soluble bromide salt, 1-phenyl-5-mercaptotetrazole; and a stabilizer selected from the group consisting of an hydroxy triazaindene, an amino triazaindene, an hydroxy tetrazaindene, an amino tetrazaindene, an hydroxy pentazaindene and an amino pentazaindene.

16 Claims, 1 Drawing Figure

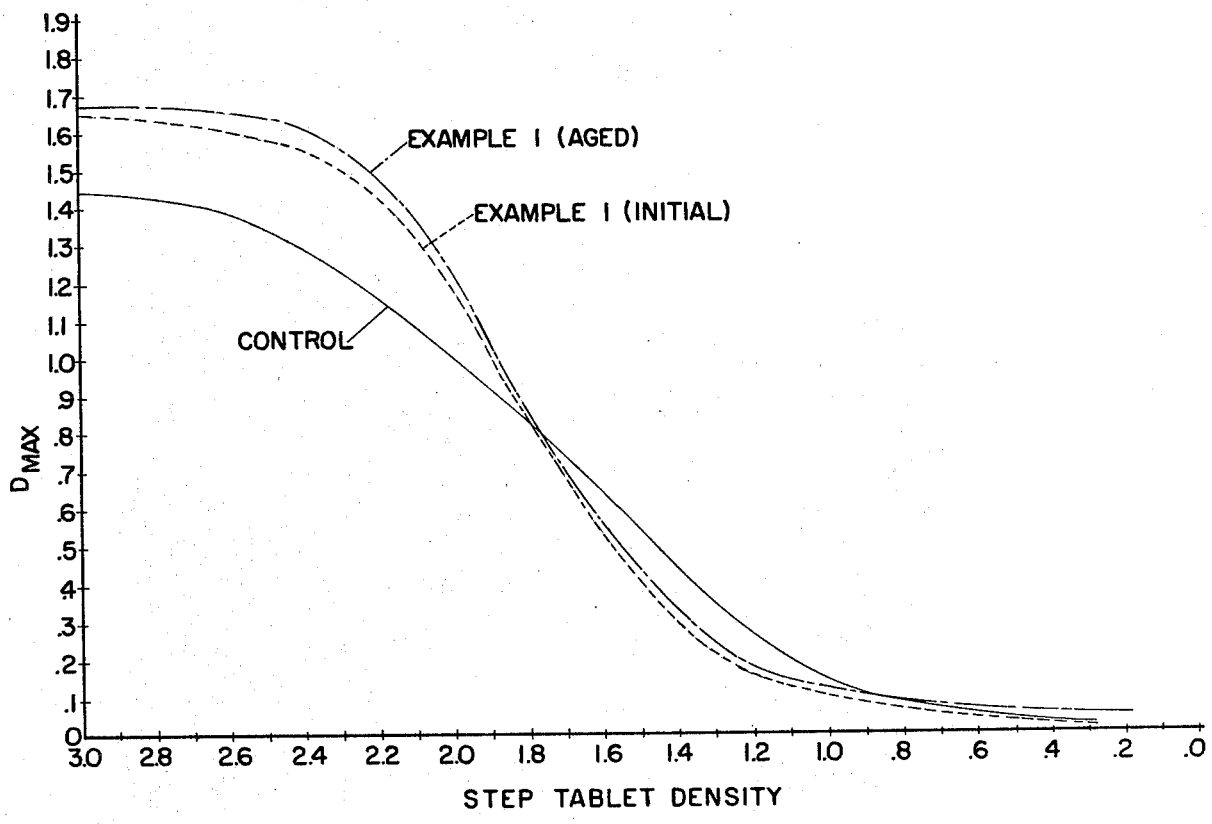
1.9
1.8
1.7
1.6
1.5
1.4
1.3
1.2
1.1
1.0
.9
.8
.7
.6
.5
.4
.3
.2
.1
0
D MAX
EXAMPLE I (AGED)
EXAMPLE I (INITIAL)
CONTROL
3.0
2.8
2.6
2.4
2.2
2.0
1.8
1.6
1.4
1.2
1.0
.8
.6
.4
.2
.0
STEP TABLET DENSITY

METHOD FOR STABILIZING AND SPECTRALLY SENSITIZING PHOTOSENSITIVE SILVER HALIDE EMULSION

CROSS REFERENCE TO RELATED APPLICATIONS

This application is a continuation of U.S. patent application Ser. No. 962,339, filed Nov. 20, 1978, now abandoned.

BACKGROUND OF THE INVENTION

It is known in the art how to stabilize silver halide emulsions with respect to shelf stability with an azaindene as illustrated, for example, in U.S. Pat. Nos. 2,444,607; 2,444,609; 2,449,225 and 2,450,397. In these listed patents, the efficacy of various azaindenes is illustrated when they are incorporated as solutions at pH 7–10 into silver halide emulsions. The patents are silent with respect to spectral sensitization of the silver halide grains.

U.S. Pat. No. 2,743,180 is directed to the treatment of unsensitized and optically sensitized silver halide emulsions with polyalkylene oxides and pentazaindenes to stabilize emulsions upon storage.

U.S. Pat. Nos. 2,772,164; 2,835,581 and 3,333,961 are directed to chemically or optically sensitized silver halide emulsions containing, as antifoggants, specified classes of triazaindenes, tetrazaindenes and pentazaindenes.

U.S. Pat. Nos. 3,418,130; 3,462,272 and 3,563,755 are directed to silver halide emulsions containing, as antifoggants, specified classes of tetrazaindenes. It is stated that these compounds do not result in the reduction of sensitivity when used. The only teaching relevant to their use is that they are added after digestion.

U.S. Pat. No. 3,161,506 is directed to color diffusion transfer processes and elements which include an optically sensitized silver halide emulsion having a dye developer associated therewith wherein the emulsion contains a member of the class consisting of hydroxy and amino triazaindenes, hydroxy and amino tetrazaindenes and hydroxy and amino pentazaindenes. The patent merely states that the emulsions contain the specified compounds; it is silent with respect to the manner of incorporating the compounds therein.

Copending application Ser. No. 918,841 filed June 6, 1978, now abandoned (commonly assigned) discloses and claims silver halide emulsions which are stabilized against the build-up of fog centers during storage without adversely affecting spectral sensitization by the following procedure:

(a) spectrally sensitizing silver halide grains with one or more spectral sensitizing dyes;

(b) lowering the pH of the emulsion from a first pH at which the silver halide grains were formed to a second pH of about 5.5 to 4.0, and/or increasing the Br ion/Ag ratio to at least 5 mg Br/gAg; and, subsequent to steps (a) and (b), (c) adding 5 to 80 mg/gAg of a stabilizer selected from the group consisting of an hydroxy triazaindene, an amino triazaindene, an hydroxy tetrazaindene, an amino tetrazaindene an hydroxy pentazaindene and an amino pentazaindene.

1-phenyl-5-mercaptotetrazole is also known in the art as an emulsion stabilizer.

SUMMARY OF THE INVENTION

The present invention is directed to the stabilization of photosensitive silver halide emulsions. The emulsions are stabilized by the following sequence of steps:

(a) providing sufficient stabilizer to the emulsion to stop chemical ripening but insufficient to interfere with spectral sensitization;

(b) spectrally sensitizing said emulsion; and (c) adding to said emulsion a water-soluble bromide salt, 1-phenyl-5-mercaptotetrazole; and a stabilizer selected from the group consisting of an hydroxy triazaindene, an amino triazaindene, an hydroxy tetrazaindene, an amino tetrazaindene, an hydroxy pentazaindene and an amino pentazaindene. Preferably, the stabilizer in step (a) is the same as in step (c), however, any material which will stop chemical ripening may be employed.

Thus, the emulsions within the scope of the present invention contain, as a stabilizing system a water-soluble bromide, 1-phenyl-5-mercaptotetrazole and at least one stabilizer selected from the group consisting of an hydroxy triazaindene, an amino triazaindene, an hydroxy tetrazaindene, an amino tetrazaindene, an hydroxy pentazaindene and an amino pentazaindene.

BRIEF DESCRIPTION OF THE DRAWING

The FIGURE reproduces characteristic curves of film units containing emulsions employing the stabilizing systems of the present invention and a prior art stabilizing system.

DETAILED DESCRIPTION OF THE INVENTION

The present invention is directed to the stabilization of photosensitive silver halide emulsions during storage. The above-mentioned stabilizers, 1-phenyl-5-mercaptotetrazole and the triazaindenes, tetrazaindenes and pentazaindenes are known to the art. However, such stabilizers have often proved to be less than effective. For example, the triazaindenes, tetrazaindenes and pentazaindenes have been generally limited in the quantities that can be employed in the emulsions since they act to displace at least some of the spectral sensitizing dyes from the silver halide grain with an attendant loss of sensitivity. The above-mentioned copending application Ser. No. 918,841, describes one solution to the problem of ensuring shelf life stability without sensitizing dye displacement.

A novel stabilizing system has now been found which will provide effective stabilization to silver halide emulsions in storage without deleteriously effecting the photographic properties of the silver halide emulsions. These advantages are achieved by introducing stabilizers into the emulsion in two separate steps with introduction of the spectral sensitizers being carried out between the two stabilizing steps. Comparing a conventionally stabilized emulsion to an emulsion stabilized by the procedure of the present invention, it will be seen that the conventionally stabilized emulsion shows $D_{max}$ loss and toe speed loss while the characteristic curve shape of the emulsion shows substantially no change upon accelerated aging.

By means of the present invention the chemical ripening of the emulsion is substantially arrested by the addition of sufficient stabilizer to so arrest chemical ripening and provide a degree of short term stability to the emulsion during the spectral sensitization period but insufficient to interfere with absorption of the sensitizing dyes to the grain, and, of course insufficient to provide long term stability to the emulsion. The long term stability is provided subsequent to spectral sensitization with a novel combination of stabilizers which provides enhanced stability at stabilizer levels lower than conventionally employed which further serves to avoid the well-known displacement of spectral sensitizing dyes by the stabilizer.

The novel method of the present invention may be applied to emulsions of substantially any halide composition. The method of preparation of the emulsion is not critical. Preferably, the emulsion is chemically ripened to optimum speed and the emulsion is then treated by the following sequence of steps.

(a) effective amounts of a water-soluble bromide, such as potassium bromide or ammonium bromide, and an hydroxy triazaindene, an amino triazaindene, an hydroxy tetrazaindene, an amino tetrazaindene, an hydroxy pentazaindene, an amino pentazaindene or combinations thereof are added to the emulsion;

(b) the spectral sensitizing dye or dyes are added to the emulsion, preferably as a mixture if a plurality of dyes are employed but they may also be added sequentially; and (c) adding effective amounts of the bromide and triazaindene, tetrazaindene and pentazaindene described in (a) above as well as 1-phenyl-5-mercaptotetrazole.

It is preferred that step (c) follow step (b) after a holding time sufficient to permit the dyes to associate themselves with the silver halide grains. In a preferred embodiment, the sensitized emulsion is held for at least about 20 minutes before the second set of stabilizers are added to the emulsion.

The amounts of stabilizers employed may vary depending upon the degree of stabilization desired and the particular emulsion employed. Preferably, the following levels are employed:

| | mg/gAg (Solids) | |
|---|---|---|
| | Range | Preferred |
| (a) | | |
| water-soluble bromide salt | 1–5 | 3 |
| triazaindene, tetrazaindene, pentazaindene | 1–7 | 6 |
| (c) | | |
| water-soluble bromide salt | 5–15 | 9 |
| triazaindend, tetrazaindene, pentazaindene | 20–40 | 26 |
| 1-phenyl-5-mercaptotetrazole | 0.1–0.5 | 0.1 |

The levels of sensitizing dyes employed are conventional in the art.

As stated above, the specific level of stabilizer employed depends on the degree of stabilization desired for a particular emulsion. As the amount of stabilizer is increased, the ultimate stability of the system is increased; however, with increasing amounts of stabilizer the speed and $D_{max}$ begins to fall off. Thus, one would select the specific levels with those considerations in mind.

It is also preferred that stabilization be carried out at a pH of about 5.0 to 5.8, more preferably 5.5.

Subsequent to the above-indicated stabilization of the emulsion, it is coated on a suitable support and incorporated into film units in a conventional manner. The emulsions prepared according to the present invention are useful in all types of film units, particularly color diffusion transfer film units and silver diffusion transfer film units.

The following non-limiting examples illustrate the novel stabilizing systems of the present invention:

EXAMPLE 1

A photosensitive silver halide emulsion composed of 6% iodide and 94% bromide with an average grain diameter of 1.60μ was prepared by conventional methods and chemically ripened to optimum speed. With the emulsion held at about 40° to 42° C. and a pH of 5.5, the following additions were carried out:

| | mg/g silver |
|---|---|
| (a) | |
| ammonium bromide | 30 |
| 4,6-dimethyl-1,3,3a,7-tetrazaindene | 4.83 |
| 4-hydroxy-6-methyl-1,3,3a,7-tetrazaindene | 1.81 |
| (b) | |
| 5,5'-dimethyl-9-ethyl-3,3'-bis-(3 sulfopropyl)-thiacarbocyanine triethylammonium salt | 0.75 |
| 5,5'-diphenyl-9-ethyl-3,3'-bis-(4-sulfobutyl)-oxacarbocyanine | 0.75 |
| anlydro-5.6-dichloro-1,3-diethyl-3'-(4''-sulfobutyl)-benzimidazolothiacarbocyanine hydroxide | 0.75 |

The emulsion was then held at 40° to 42° C. for 20 minutes and then the following materials were added:

| | mg/g silver |
|---|---|
| (c) | |
| ammonium bromide | 9.01 |
| 1-phenyl-5-mercaptotetrazole | 0.103 |
| 4-hydroxy-6-methyl-1,3,3a,7-tetrazaindene | 26.51 |

As a control, an emulsion of the same halide content and grain size set forth in Example 1 was provided with the following stabilizing system after chemical ripening to optimum speed.

| | mg/g silver |
|---|---|
| ammonium bromide | 2.98 |
| 4,6-dimethyl-1,3,3a,7-tetrazaindene | 2.4 |
| 4-hydroxy-6-methyl-1,3,3a,7-tetrazaindene | 1.79 |

Spectral sensitization was then carried out as above.

The figure reproduces characteristic curves obtained with the above described emulsions. It will be noted that the curve obtained from a film unit having the emulsion stabilized by the present invention after accelerated aging for 5 days at 120° F. is substantially identical to the curve generated without aging. However, the control showed $D_{max}$ and toe speed loss on aging 5 days at 120° F.

As stated above, the novel stabilized emulsions of the present invention can be employed satisfactorily in both color diffusion transfer processes and silver halide diffusion transfer processes known to the art, as illustrated, for example, in the following U.S. Pat. Nos.: 2,543,181; 2,983,606; 3,415,644; 3,415,645; 3,415,646; 3,473,925; 3,482,972; 3,551,406; 3,573,042; 3,573,043; 3,573,044; 3,576,625; 3,576,626; 3,578,540; 3,569,333; 3,579,333; 3,594,164; 3,594,165; 3,597,200; 3,647,437; 3,672,486;

3,672,890; 3,705,184; 3,752,836; 3,857,865 and British Pat. No. 1,330,524 all of which are incorporated here in their entirety.

What is claimed is:

1. A method for stabilizing a photosensitive silver halide emulsion which comprises the following steps, in sequence:

(a) adding to said emulsion a stabilizer in an amount sufficient to substantially arrest chemical ripening but insufficient to interfere with spectral sensitization;

(b) spectrally sensitizing said emulsion; and (c) adding to said spectrally sensitized emulsion a water-soluble bromide salt, 1-phenyl-5-mercaptotetrazole and a stabilizer selected from the group consisting of an hydroxy triazaindene, an amino triazaindene, an hydroxy tetrazaindene, an amino tetrazaindene, an hydroxy pentazaindene and an amino pentazaindene.

2. A method for stabilizing a photosensitive silver halide emulsion which comprises the following steps, in sequence:

(a) adding to said emulsion a water-soluble bromide salt and a stabilizer selected from the group consisting of an hydroxy triazaindene, an amino trizaindene, an hydroxy tetrazaindene, an amino tetrazaindene, an hydroxy pentazaindene and an amino pentazaindene; said bromide salt and said stabilizer being added in an amount sufficient to substantially arrest chemical ripening but insufficient to interfere with spectral sensitization;

(b) spectrally sensitizing said emulsion; and (c) adding to said spectrally sensitized emulsion a water-soluble bromide salt, 1-phenyl-5-mercaptotetrazole and a stabilizer selected from the group consisting of an hydroxy triazaindene, an amino triazaindene, an hydroxy tetrazaindene, an amino tetrazaindene, an hydroxy pentazaindene and an amino pentazaindene.

3. The method of claim 2 wherein said water-soluble bromide salt is ammonium bromide.

4. The method of claim 2 wherein said water-soluble bromide salt is potassium bromide.

5. The method of claim 2 wherein said stabilizer in step (a) comprises triazaindolizine.

6. The method of claim 5 wherein said triazaindolizine is a combination of 5,7-dimethyl-1,3,4-triazaindolizine and 5-methyl-7-hydroxy-1,3,4-triazaindolizine.

7. The method of claim 2 wherein said stabilizer in step (c) is 5-methyl-7-hydroxy-1,3,4-triazaindolizine.

8. The method of claim 2 wherein the emulsion prior to step (a) has been chemically ripened to optimum speed.

9. The method of claim 8 wherein steps a, b and c are carried out at a pH of about 5.0 to 5.8.

10. The method of claim 9 wherein said pH is about 5.5.

11. The method of claim 2 wherein in step (a) said water-soluble bromide is present at a level of about 1–5 mg/g silver and said stabilizer is present at a level of about 1–7 mg/g silver.

12. The method of claim 11 wherein said water-soluble bromide is present at about a level of 3 mg/g silver and said stabilizer at a level of about 6 mg/g silver.

13. The method of claim 2 wherein in step (c) water-soluble bromide is at a level of about 5–15 mg/g of silver; said 1-phenyl-5-mercaptotetrazole is at a level of about 0.1–0.5 mg/g silver and said stabilizer is at a level of about 20–40 mg/g silver.

14. The method of claim 2 wherein subsequent to step (b) and prior to step (c) said emulsion is held for a time sufficient to associate the spectral sensitizing dyes with the silver halide grains.

15. The method of claim 2 wherein said spectral sensitization is pan sensitization.

16. A method for stabilizing a photosensitive silver bromoiodide emulsion which comprises the following steps, in sequence:

(a) adding to said emulsion a water-soluble bromide salt and a stabilizer selected from the group consisting of an hydroxy triazaindene, an amino triazaindene, an hydroxy tetrazaindene, an amino tetrazaindene, an hydroxy pentazaindene and an amino pentazaindene; said bromide salt and said stabilizer being added in an amount sufficient to substantially arrest chemical ripening but insufficient to interfere with spectral sensitization;

(b) spectrally sensitizing said emulsion; and (c) adding to said spectrally sensitized emulsion a water-soluble bromide salt, 1-phenyl-5-mercaptotetrazole and a stabilizer selected from the group consisting of an hydroxy trizazindene, an amino triazaindene, an hydroxy tetrazaindene, an amino tetrazaindene, an hydroxy pentazaindene and an amino pentazaindene;

said steps being carried out at a pH of 5.0 to 5.8.

* * * * *